United States Patent [19]

Marchese

[11] 4,072,855

[45] Feb. 7, 1978

[54] LAMP WITH CHANGING LUMINOUS EFFECTS

[76] Inventor: Ludovico Marchese, Strada alla Morana 6, Casale Monferrato (Alessandria), Italy, 15033

[21] Appl. No.: 652,811

[22] Filed: Jan. 27, 1976

[51] Int. Cl.[2] ..... A47G 33/16

[52] U.S. Cl. ..... 362/101; 362/806

[58] Field of Search ..... 240/10 A, 10 R, 10 B, 240/10 P, 10.6 R; 350/5

[56] References Cited

U.S. PATENT DOCUMENTS

| | | | |
|---|---|---|---|
| 2,297,767 | 10/1942 | Hunt | 350/5 X |
| 2,569,078 | 9/1951 | Silver et al. | 240/10 A X |
| 2,631,409 | 3/1953 | Windiate | 240/10 P X |
| 2,757,570 | 8/1956 | Molnar | 350/5 X |
| 2,841,781 | 7/1958 | Lob et al. | 240/10.6 R |
| 3,531,635 | 9/1970 | Hancock | 240/10 A |
| 3,748,013 | 7/1973 | Orans | 350/5 |
| 3,755,664 | 8/1973 | Reiback | 240/10 R |
| 3,995,151 | 11/1976 | Nordeen et al. | 240/10 A |

FOREIGN PATENT DOCUMENTS

| | | | |
|---|---|---|---|
| 1,038,891 | 5/1953 | France | 240/10 R |
| 944,446 | 12/1963 | United Kingdom | 240/10 A |

*Primary Examiner*—Donald Griffin

*Attorney, Agent, or Firm*—Browdy and Neimark

[57] ABSTRACT

A lamp having a moving luminous aesthetic effect made up of a luminous incandescent source directed through a transparent container above the luminous source and being filled with a liquid mixture of trichloroethylene and dichloroethylene having dispersed therein a plurality of platelets adapted to float in the liquid, each of the platelets having at least one reflecting surface thereon.

16 Claims, 2 Drawing Figures

LAMP WITH CHANGING LUMINOUS EFFECTS

FIELD OF THE INVENTION

The present invention relates to a lamp capable of emitting variably changing luminous rays to provide a moving luminous effect which may be utilized for aesthetic purposes, particularly as an advertising device.

BACKGROUND OF THE INVENTION

Lamps of the above said type are known whose movement effect of the luminous rays is obtained by associating with a luminous source, one or more reflecting and/or refracting surfaces which are rotated or angularly swung by means of a motor, particularly a small electrical motor.

OBJECT OF THE INVENTION

One object of the present invention is to provide a lamp with a moving luminous effect wherein no motive member is necessary to move the reflecting surfaces. Another object of the invention is to provide a lamp with a movement effect of the luminous beams which is greatly evident and of the sparkling type, substantially similar to the light reflected by a greatly faceted polyhedric crystal.

A further object of the invention is to provide a lamp as already specified which may be made of any size by varying the suitable power of the luminous source only.

A further object of present invention is to provide a lamp, as previously specified, having a practically unlimited life and a reliable operation, whose efficiency depends only on the efficiency of the luminous source.

SUMMARY OF THE INVENTION

To attain the above and other objects which will become evident through the following specification, the present invention has as its subject matter a lamp comprising an incandescent luminous source contained within a pedestal and a transparent container located above the luminous source; this container being filled with a liquid mixture of trichloroethylene and dichloroethylene, wherein there are dispersed metallized platelets having such a thickness relative to the surface of the platelets and to the liquid density at room temperature, as to allow said platelets to float each of the platelets; having at least one face which is polished to reflect the beams emitted by the luminuous source; the luminous source generating, in a surprising manner, the movement of the platelets within the liquid and the sparkling of the luminous beams, due to the reflection produced by the polished faces of the platelets.

BRIEF DESCRIPTION OF THE DRAWINGS

The invention will be now described in detail with reference to the accompanying drawings given only as a non limiting embodiment example and wherein.

DESCRIPTION OF THE EMBODIMENT

Figures 1, 2:
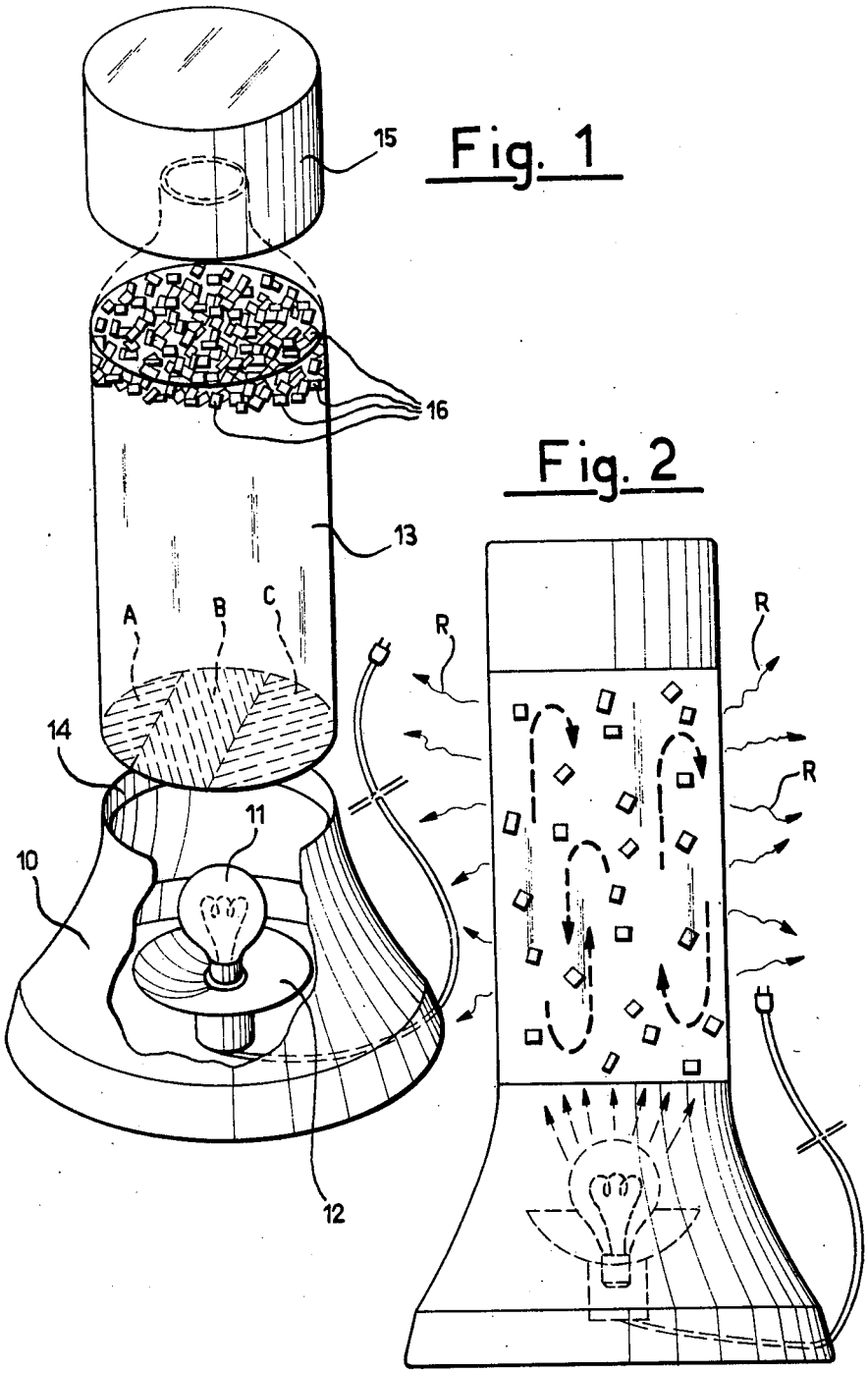
FIG. 1 illustrates the lamp with its components.
FIG. 2 is an elevation view showing schematically the operation of the same lamp.

As shown on the drawings, the lamp comprises a base 10 containing a luminous source 11 of the incandescent type, suitable to emit luminous rays comprising also infrared rays so that this source is also a heating source. The source 11 may be advantageously an electric bulb with a tungsten filament and preferably located in the focal zone of a paraboloid 12 in order to direct upwardly and parallelly the luminous rays.

A container 13 made of a transparent material, e.g. glass, is located above source 11. A common bottle of the type having a flat bottom may be used as the container.

The container will be located on a suitable retaining seat 14 of the base 10 and when it is a bottle, it will be fitted with a cylindrical cover 15 which hides the upper part of the bottle. The container contains a liquid formed of a mixture of trichlorothylene, whose formula is $CHCl = CCl_2$ (boiling point 85° C; density = 1.47) and dichloroethylene, whose formula is $CHCl = CHCl$ (boiling point 52° C; density = 1.27).

This mixture substantially fills the container leaving a small air volume and the metallized platelets generally indicated by 16 are dispersed in the mixture. The platelets will be preferably formed of a base of a plastic material coated with a metal layer formed by galvanic deposition and will have a thickness selected in relation to their surface and the density of the mixture contained in the vessel, in order to allow their floating; the mixture density being referred to the room temperture of about 20° C.

When the luminous source 11 is activated, after a short time period variable from 1 to 3 ;min., an active mixing of platelets 16 surprisingly occurs within the liquiid because of convection currents and density variations of the liquid generated by heat from the source 11. These platelets move in a disorderly way from top to bottom and vice versa within the container and by reflecting the source light, they produce a showy movement and sparkling effect.

In order to produce the phenomenon in a satisfactory way, it is necessary to respect the following metering and size limits of the components:

The ratio between the trichloroethylene and the dichloroethylene is between 7 and 11. The amount (weight) of metallized platelets referred to 1000 gr. of mixture varying from 15 to 25 gr. The platelet thickness/surface ratio varying from 0.7 to 1.5 micron/$mm^2$; the size limit of the surface being comprised between 10 and 100 $mm^2$.

From the numerous experiments made it has been observed that a critical ratio is established between the luminous source power (watts) and the container 13 volume; the best ratio being of 40 watts per liter.

According to the above stated limits, a practical embodiment example of the lamp according to the invention will be now described.

EXAMPLE

A container 13 having a volume of one liter, e.g. a bottle of a clear glass, is filled with 1000 gr. of a mixture comprising 900 gr. of trichloroethylene and 100 gr. of dichloroethylene. 20 gr. of platelets made of polyvinylchloride, and having an added aluminum layer, are introduced in the mixture; each platelet having a total thickness of 20 $\mu$ (micron) and a surface of 25 $mm^2$.

One face at least of the platelet will have been polished so as to be greatly reflecting, and the container is then sealed.

The luminous source used 11 is a lamp with a tungsten filament, having a power of 40 watts. About three or four minutes after the lighting of the lamp, the platelets initiate their movements within the liquid, by following ascending and descending trajetories, as shown on FIG. 2.

In their ascending and descending movement the platelets 16 rotate also on themselves reflecting the source 11 luminous rays in continuously varying directions, as schematically shown and indicated by R on FIG. 2.

If the container 13 bottom is provided with differently colored zones, as indicated by A, B, C, the sparkling effect is pleasantly emphasized by the continuously changing color of the reflected rays.

The present invention is not limited, of course, by the example described and, many constructive variants may be introduced on the base of the above made specification and the accompanying drawings, without departing from the scope of the invention.

Thus, e.g., the platelets also may be colored or may carry advertising inscriptions or the like.

I claim:

1. A lamp with changing luminous effects comprising means to provide heat and light and a transparent container located adjacent said means to provide heat and light; said container being filled with a mixture of liquids, the density of the liquid mixture varying with the temperature of said means to provide heat, the liquid mixture having metallized platelets dispersed therein which have a thickness which, related to the surface thereof and to the density of the liquid mixture at room temperature, is such that said platelets float on said liquid at room temperature, but do not float when said liquid has been heated by said heating means; the platelets each having at least one face which has been polished to reflect the rays emitted by the means to provide light; the means to provide heat and light generating a movement of the platelets within the liquid and sparkling of the luminous rays, due to the reflection produced by the polished faces of said platelets, the motion of the platelets resulting from convection currents in the liquid mixture and variation in density in the liquid due to the heating effect of said means to provide heat.

2. A lamp according to claim 1, wherein the liquid mixture fills the container leaving a small air volume.

3. A lamp according to claim 1, wherein the thickness/surface ratio of the metal platelets ranges between 0.7 and 1.5 micron/mm$^2$; while the surface dimension limit is between 10 and 100 mm$^2$.

4. A lamp according to claim 1, wherein the amount (by weight) of the metal platelets, referred to 1000 gr of liquid mixture, is between 15 and 25 gr.

5. A lamp according to claim 1, wherein the platelets are formed of a base of a plastic material coated with at least one metal layer obtained by galvanic deposition.

6. A lamp according to claim 1, wherein the means to provide heat and light emits rays also within the infrared range and is an incandescent lamp having a tungsten filament.

7. A lamp according to claim 1, wherein the bottom of the container is multicolored.

8. A lamp according to claim 1, whereim the container is a transparent glass bottle having a flat bottom.

9. A lamp in accordance with claim 1 wherein said means to provide heat and light is a single means comprising an incandescent light bulb located beneath said transparent container.

10. A lamp according to claim 9, wherein the ratio between the power of said means to provide heat and light and the volume of the container is between 35 and 45 watts/liter.

11. A lamp in accordance with claim 9 wherein said mixture of liquids comprises a mixture of trichloroethylene and dichloroethylene.

12. A lamp according to claim 11, wherein the weight ratio between the trichloroethylene and the dichloroethylene is between 7 and 11.

13. A lamp in accordance with claim 1 wherein said means to provide heat is located below said mixture of liquid in said container.

14. A lamp for providing changing luminous effects, comprising:

a lamp lower portion having a chamber therein, and a luminous means for generating heat and light housed within said lower portion;

a transparent container located above said lamp lower potion and in light communication therewith, said container being filled with a clear liquid and a plurality of reflective platelets dispersed and floating in said liquid, the density of said liquid being between 1.27 and 1.47 and the density of said reflective platelets being slightly less than the density of said liquid such that at room temperature and under quiescent conditions said reflective particles float on said liquid;

multi-colored means located between said luminous means and said liquid to cause luminous rays from said luminous means to be multi-colored; and means to cause convection currents and a decrease in density in said liquid, in turn causing said reflective platelets to sink into said liquid and causing movement of said reflective platelets within said liquid and sparkling of luminous rays by reflection of light from said luminous means to and off of said reflective platelets, said means comprising means to activate said luminous means.

15. A lamp in accordance with claim 14 wherein said liquid comprises a mixture of 7–11 parts by weight of trichloroethylene per part of dichloroethylene; said reflective platelets comprise metallized plastic platelets of 15–25 gms. per 1000 gms. of said liquid; the thickness/surface ratio being 0.7 to 1.5 microns/mm$^2$; and the surface area of said platelets being 10 – 100 mm$^2$.

16. A lamp in accordance with claim 15 wherein said luminous means comprises an incandescent bulb of approximately 40 watts per liter of said liquid.

* * * * *